US009422136B2

(12) United States Patent
Alasentie

(10) Patent No.: US 9,422,136 B2
(45) Date of Patent: Aug. 23, 2016

(54) METHOD FOR REPLACING THE ROPES OF AN ELEVATOR, AND AN ELEVATOR

(75) Inventor: Pentti Alasentie, Espoo (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 13/528,554

(22) Filed: Jun. 20, 2012

(65) Prior Publication Data

US 2012/0255150 A1 Oct. 11, 2012

Related U.S. Application Data

(63) Continuation of application No. PCT/FI2010/051056, filed on Dec. 17, 2010.

(30) Foreign Application Priority Data

Dec. 21, 2009 (FI) ..... 20090494

(51) Int. Cl.
*B66B 7/06* (2006.01)
*B66B 19/02* (2006.01)

(52) U.S. Cl.
CPC ..... *B66B 19/02* (2013.01); *Y10T 29/4973* (2015.01); *Y10T 29/49716* (2015.01)

(58) Field of Classification Search
CPC B66B 19/02; B66B 19/007; Y10T 29/49716; Y10Y 29/4973; D07B 2801/16; D07B 2801/22
USPC ..... 29/401.1, 402.03, 402.08; 187/249, 187/250, 251, 259, 262, 266, 405, 406, 187/411; 33/401.1, 402.03, 402.08
See application file for complete search history.

(56) References Cited

U.S. PATENT DOCUMENTS

| | | | | |
|---|---|---|---|---|
| 3,720,291 | A * | 3/1973 | Ivanov | 187/266 |
| 5,117,945 | A * | 6/1992 | Honda | 187/264 |
| 7,357,226 | B2 * | 4/2008 | Sakita | 187/249 |
| 8,360,212 | B2 * | 1/2013 | Hagg et al. | 187/411 |
| 2009/0127033 | A1 * | 5/2009 | Korkeakangas et al. | 187/414 |
| 2012/0124807 | A1 * | 5/2012 | Mertala et al. | 29/428 |

FOREIGN PATENT DOCUMENTS

| | | | |
|---|---|---|---|
| FI | 120080464 | * | 9/2009 |
| FI | 120090310 | * | 8/2010 |

OTHER PUBLICATIONS

International Search Report and Written Opinion.
Supplementary European Search Report for corresponding European application No. 10838747.3 dated Oct. 20, 2015.

* cited by examiner

*Primary Examiner* — Lee A Holly
(74) *Attorney, Agent, or Firm* — Harness, Dickey & Pierce, P.L.C.

(57) ABSTRACT

A method for replacing the elevator ropes in an elevator provided with at least a hoisting machine, a traction sheave and a counterweight, in which the elevator car is supported with elevator ropes and which elevator comprises compensating ropes. In connection with the first rope replacement the compensating ropes are converted into the hoisting ropes of the elevator and at least a part of the hoisting ropes are converted into the compensating ropes of the elevator.

15 Claims, 5 Drawing Sheets

METHOD FOR REPLACING THE ROPES OF AN ELEVATOR, AND AN ELEVATOR

CROSS-REFERENCE TO RELATED APPLICATIONS

This application is a continuation of International Application Number PCT/FI2010/051056 filed on Dec. 17, 2010 and claims priority to Finnish Application Number FI 20090494 filed on Dec. 21, 2009, the entire contents of each of which are hereby incorporated herein by reference.

BACKGROUND

The object of the present invention is a method for replacing the ropes of an elevator, and an elevator.

The hoisting ropes of an elevator must during their service life travel many times over a traction sheave and possibly also over one or more diverting pulleys. In addition to other stressing, these bendings that occur at the point of traction sheaves and diverting pulleys considerably wear the hoisting ropes. Therefore a certain calculated service life exists for the hoisting ropes of an elevator, after which the hoisting ropes must be replaced for new ones, even if no damage is detectable in them. This calculated service life is e.g. 7-8 years. The compensating ropes of an elevator, on the other hand, are not subjected to such harsh stressing, so that they last well and they can be used for a much longer time than the hoisting ropes.

A problem in prior-art solutions is that the hoisting ropes to be taken out of service are mainly waste and therefore they cause a load on the environment. Another drawback is the cost incurred by new hoisting ropes and the use of customer premises necessitated by the replacement work as well as the discomfort caused to residents and other users of the elevator. One drawback is also the separate hoists and other auxiliary devices needed in the replacement work.

SUMMARY

The aim of this invention is to eliminate the aforementioned drawbacks and to achieve a simple, inexpensive and environmentally friendly method for replacing the ropes of an elevator. Another aim of the invention is to produce a method for replacing the ropes of an elevator wherein at least on the first replacement occasion no new hoisting ropes at all are needed, in which case at least one hoisting rope batch is saved in each elevator. The objective is also to produce a rapid replacement method, in which the changing of the ropes can be implemented mainly with the elevator's own machine, without needing separate hoists and the support solutions to be made for them.

Some inventive embodiments are also discussed in the descriptive section of the present application. The underlying idea of the invention is that an elevator contains, both as hoisting ropes and as compensating ropes, ropes that are suited for use as the hoisting ropes of the elevator in question. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. Likewise the different details presented in connection with each embodiment can also be applied in other embodiments. In addition it can be stated that at least some of the subordinate claims can at least in some situations be deemed to be inventive in their own right.

Often elevators comprise more hoisting ropes than compensating ropes. In this case all the compensating ropes are changed in connection with the first rope replacement into hoisting ropes and a corresponding number of hoisting ropes into compensating ropes.

By making the fixing method of the compensating ropes and of the hoisting ropes similar to each other, for example, the replacement can be facilitated. Likewise if the compensating ropes and the hoisting ropes are of the same length as each other, the replacement of one with the other is quite simple. If the suspension lengths of the elevator ropes and hoisting ropes of the elevator differ so much from each other that the additional length needs of either the compensating ropes or of the hoisting ropes resulting from the replacement cannot be fitted with the fixing means, a length reservation can be made in the ropes for these types of needs, which length reservation is taken into use in the replacement. Preferably the length reserve is made to the shorter ropes of the compensating ropes or hoisting ropes.

One advantage of the solution according to the invention is that by means of it the replacement of ropes can be performed quickly. Preferably in the method the replacement work is performed without separate lifting devices, utilizing the hoisting machine of the elevator. Thus the space needed in the replacement work is small, and the replacement work with its accessories does not disturb the residents or users of the building. Another advantage is the savings in material and costs, because one hoisting rope batch is saved. In this case the service life of the first hoisting rope batch can be almost doubled. This advantage is pronounced in high-rise buildings, in which the elevators comprise many ropes and the ropes are extremely long. Correspondingly, savings are made in logistics and the replacement time of the ropes is short because it is not necessary to perform, among other things, a separate termination of the endings of the ropes. Additionally, another advantage is the ecofriendliness of the solution, because in this way the rope batch to be saved does not go to waste.

BRIEF DESCRIPTION OF THE DRAWINGS

In the following the invention will be described in more detail by the aid of one example of its embodiment with reference to the attached drawings, wherein.

DETAILED DESCRIPTION OF EXAMPLE EMBODIMENTS

Figure 1:
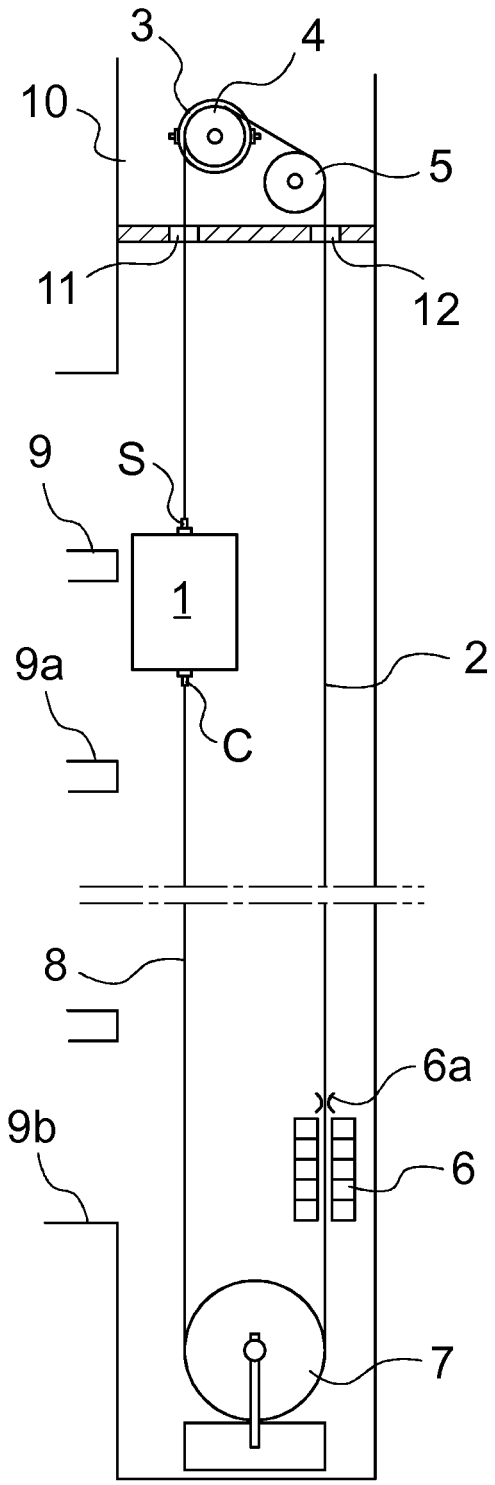
FIG. 1 presents a simplified and diagrammatic side view, cut in the height direction of the hoistway, of one elevator in the initial stage of the replacement of the ropes, wherein the method according to the invention is applied.

For the sake of clarity the trailing cable has not been visibly drawn in the figures. The following equation applies between the unit mass, which is expressed with the unit kg/m, of the elevator hoisting rope, the trailing cable and the compensating rope:

$$M_S=M_C+0.25*M_{TC}$$

where $M_S$=the unit mass of the hoisting ropes $M_C$=the unit mass of the compensating ropes $M_{TC}$=the unit mass of the trailing cable.

In the situation presented by the equation above the compensation of the ropes is exactly 100%. In practice, however, there is sufficient accuracy when the compensation is e.g. between 97-102%.

Correspondingly, by means of the unit mass of the hoisting ropes and of the trailing cable, the limit values A of the unit mass of a hoisting rope for the different number n of ropes can be calculated. The following equation is valid for the calculation:

$$((n-1)*M_S+0.25*M_{TC})/n*M_S=A=0.97-1.02$$

It follows from the above that:

$$M_S=0.25*M_{TC}/((A-1)*n+1)$$

When the number of hoisting ropes is taken to be $n=n_1=10$ units, the limit values obtained are:

$$M_{S97}=0.3571*M_{TC} \text{ and } M_{S102}=0.2083*M_{TC}$$

Correspondingly, when the number of hoisting ropes is taken to be $n=n_2=9$ units, the limit values obtained are:

$$M_{S97}=0.3425*M_{TC} \text{ and } M_{S102}0.2119*M_{TC}$$

It can be noted on the basis of the above theory that the compensating ropes can be selected such that the hoisting ropes and the compensating ropes are similar ropes, but one less compensating rope than the hoisting ropes is sufficient. This observation is one fundamental concept in the present invention.

In the embodiment of the invention described in the following, one extra hoisting rope 2 is installed in a new elevator. In other words, if according to the calculations e.g. ten hoisting ropes should be installed in the elevator, now eleven hoisting ropes 2 are installed. Correspondingly, one less compensating rope is needed, so that ten units of compensating ropes 8 are installed in the elevator. Both the hoisting ropes and the compensating ropes are parallel with each other and are presented in the figures as only one rope. The hoisting ropes 2 and the compensating ropes 8 are essentially similar to each other. In the case according to the embodiment, all the compensating ropes 8 and ten hoisting ropes 2 are additionally the same rope such that each hoisting rope 2 is fixed at its first end S to the top of the elevator car 1, from where each hoisting rope 2 is led to the machine room 10 via the aperture 11 and over the traction sheave 4 of the elevator machine 3 in the machine room 10 and onwards over the diverting pulley 5 as well as downwards from the diverting pulley 5 via the aperture 12 to the counterweight 6 and onwards through the counterweight 6 to the compensating pulley 7. After passing around the bottom of the compensating pulley 7, each rope is led onwards up to the fixing point that is below the elevator car, to which fixing point the second end C of the rope is fixed.

The hoisting ropes 2 are fixed to the counterweight 6 with a fixing means **6*a* that does not break the rope above the counterweight, through which fixing means the ropes go. Even if the fixing means 6*a* were to cause some small damages to the hoisting rope 2, it would not produce problems because this point of the hoisting rope never in operation travels over the traction sheave 4 nor over the diverting pulley 5, so the aforementioned point is not subjected to bending fatigue. The positioning of the fixing means 6*a* above the counterweight 6 is selected such that the length of the rope from the fixing point of the first end S to the fixing means 6*a* is essentially the same as the length of the rope from the fixing point of the second end C of the rope to the fixing means 6*a***.

The rope between the fixing means **6*a* and the fixing point of the second end C of the rope functions as a compensating rope 8, whereas between the fixing means 6*a* and the fixing point of the first end S the same rope functions as a hoisting rope 2. Thus there are ten units of long ropes of this type in the elevator according to the embodiment. In addition, the elevator comprises one shorter hoisting rope 2, which is also similar to, and the same manufacturing batch as, the other ropes, but this rope extends from its fixing point of the first end S only to a separate fixing point that is on the counterweight 6**, which fixing point is not presented in the figures. Thus the compensating condition presented above is fulfilled.

When the hoisting ropes 2 installed into a new elevator in this way have been in use e.g. 8 years, they must according to elevator regulations be replaced with new ropes for safety reasons. In this case in the replacement method according to the invention the compensating ropes that have been in use are changed into hoisting ropes and some of the hoisting ropes that have been in use are disposed as new compensating ropes. Since the original number of hoisting ropes was n+1, i.e. 11 units, and of compensating ropes was n+1−1=n, i.e. 10 units, therefore n+1−2=n−1, i.e. nine ropes, of the original hoisting ropes are changed into compensating ropes. Thus two ropes are left over from the original hoisting ropes, but not everything needs to be thrown away. The stressing of the compensating ropes 8 has been extremely small during operation and they still have several years of service life remaining, although they would no longer meet the eight years according to regulations. Although there is one less of the new hoisting ropes 2 replaced in this way than there were originally, the ropes meet all safety requirements and the number of hoisting ropes is sufficient, because originally there was one extra hoisting rope 2.

Correspondingly, the former hoisting ropes are still very good as compensating ropes because stressing of compensating ropes is extremely small and a possible increase in wire breakages is not a safety risk. Short auxiliary ropes for the replacement of the ropes can be made from at least one of the original hoisting ropes that is left over.

When the roping of the elevator is arranged in the manner described above, replacement of the ropes is performed with the method according to the invention e.g. as follows:

FIG. 1 presents the situation prior to the replacement of the ropes. For changing the ropes the elevator car 1 is driven in the hoistway to such a position that there is access to the roof of the elevator car 1 from the topmost floor level 9. When the elevator car 1 is in the correct height position, it is locked to the guide rails e.g. with wedges. Correspondingly, in this case there is access to below the elevator car 1 from the next-to-topmost floor level 9*a*. In addition, a working platform is installed in the elevator hoistway below the elevator car 1 for the replacement work. The working platform is not shown in the figures. When the elevator car 1 is locked into its position near the topmost floor level 9, the counterweight 6 is in the bottom part of the hoistway near the lowermost floor level 9*b*, from where there is access to the counterweight 6. The counterweight 6 is also locked into its position to its own guide rails. In addition, a working platform is also installed in the elevator hoistway in the proximity of the counterweight 6 for the replacement work. This working platform is also not shown in the figures.

Figure 2:
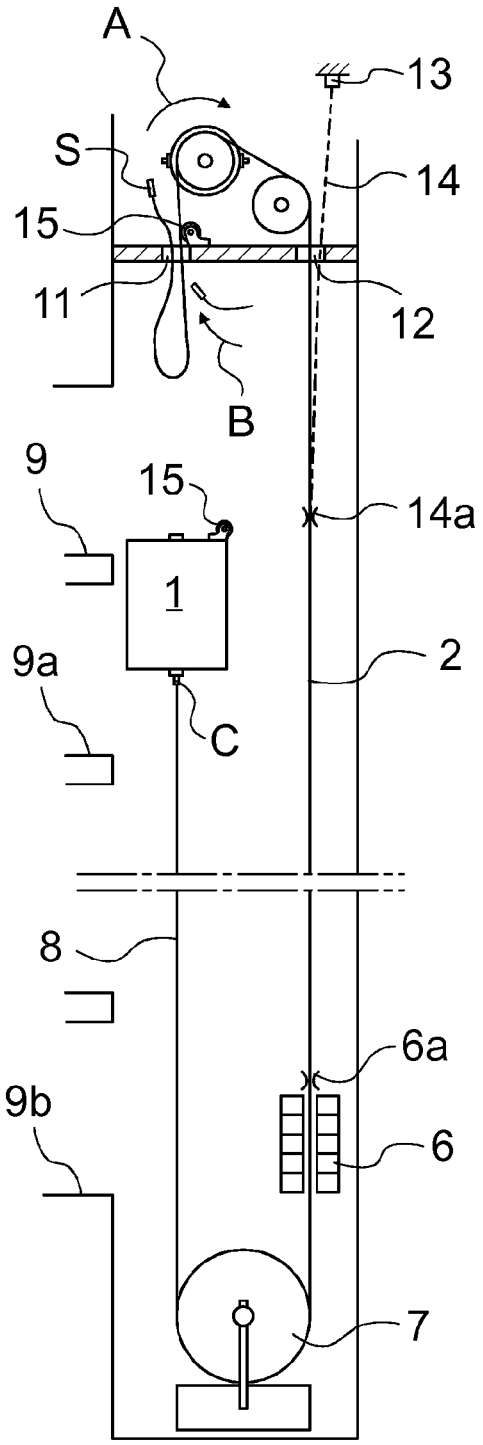
FIG. 2 presents a simplified and diagrammatic side view of an elevator according to FIG. 1, wherein the operation for replacement of the ropes has started.

FIG. 2 presents one situation from the next phase of the method. In this phase a guide pulley 15 for guiding the ropes to travel past the elevator car is disposed on the top edge of the elevator car 1 and likewise a guide pulley 15 for guiding the ropes to travel via the aperture 11 to the traction sheave is disposed in the machine room 10. In addition, a support means 14 is fixed to the hoisting ropes 2 between the diverting pulley 5 and the counterweight 6, the top end of which is fixed to a fixing point 13 e.g. in the machine room 10, and the bottom end of which is a fixing means 14*a* that does not break the hoisting ropes 2, which fixing means is fixed to the hoisting ropes 2. The support means 14 is led from the machine room 10 to the fixing point of the hoisting ropes 2 via an aperture 12 in the floor of the machine room. The purpose of the support means 14 is to prevent the dropping of the hoisting ropes 2 to the bottom of the hoistway when the hoisting ropes 2 are detached from the elevator car 1. Some of one hoisting rope 2 left over in the replacement, for example, is used in the support means 14.

Figure 3:
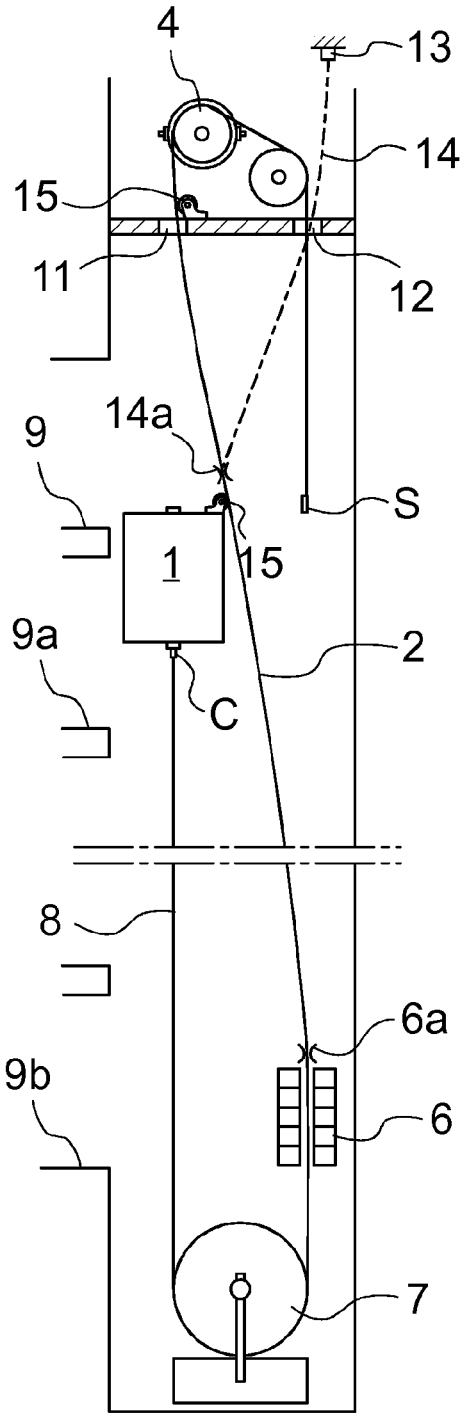
FIG. 3 presents a simplified and diagrammatic side view of an elevator according to FIG. 1, wherein the hoisting ropes have been detached, removed from the traction sheave and re-threaded onto the traction sheave from a direction that is opposite to the original direction.

When the support means 14 is fixed to support the hoisting ropes 2, the first ends S of the hoisting ropes are detached from their fixing points on top of the elevator car. The detached first ends S are lifted into the machine room 10 via the aperture 11 in the floor of the machine room and bent over the traction sheave 4 and also over the diverting pulley 5 in the direction away from this sheave and pulley indicated by the arrow A. After this the first ends S of the hoisting ropes are lowered out of the machine room 10 via the aperture 12 and transferred in the direction indicated by the arrow B into the machine room again via the aperture 11 and bent over the traction sheave 4 as well as over the diverting pulley 5 back to this sheave and pulley in the direction indicated by the arrow A and lowered finally out of the machine room 10 via the aperture 12, in which case the first ends S remain free to hang in the hoistway, as presented in FIG. 3. Thus the direction of the hoisting ropes 2 over the traction sheave 4 and the diverting pulley 5 has been changed to be the opposite.

Figure 4:
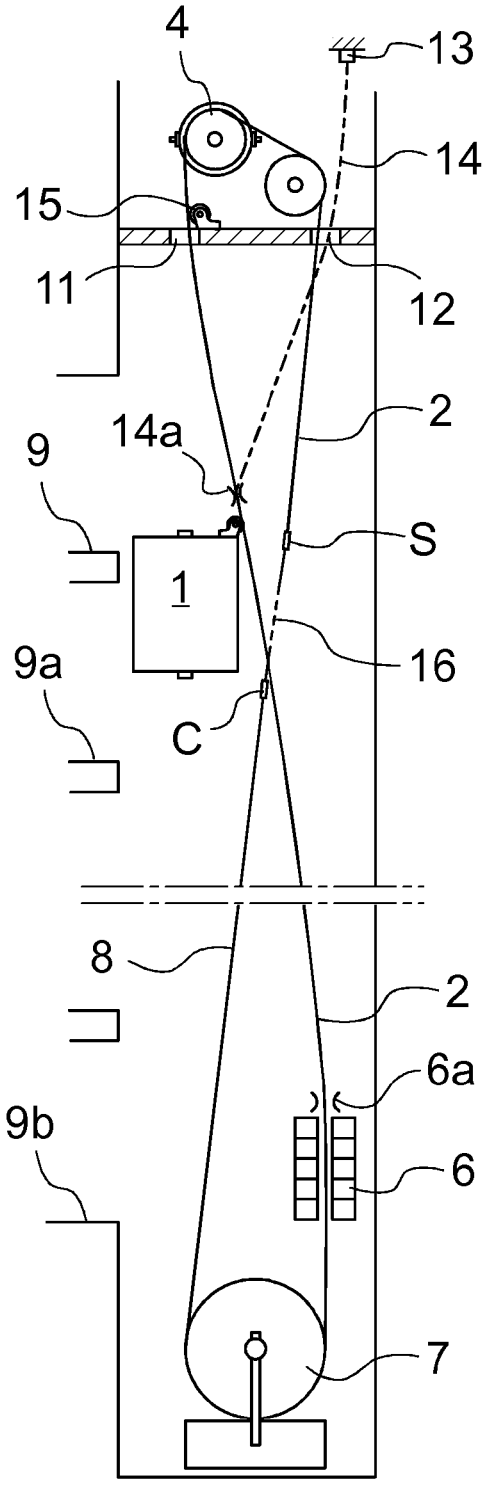
FIG. 4 presents a simplified and diagrammatic side view of an elevator according to FIG. 1, wherein the hoisting ropes and the compensating ropes have been detached from the elevator car and fixed to each other at their ends via an intermediate piece.
Figure 5:
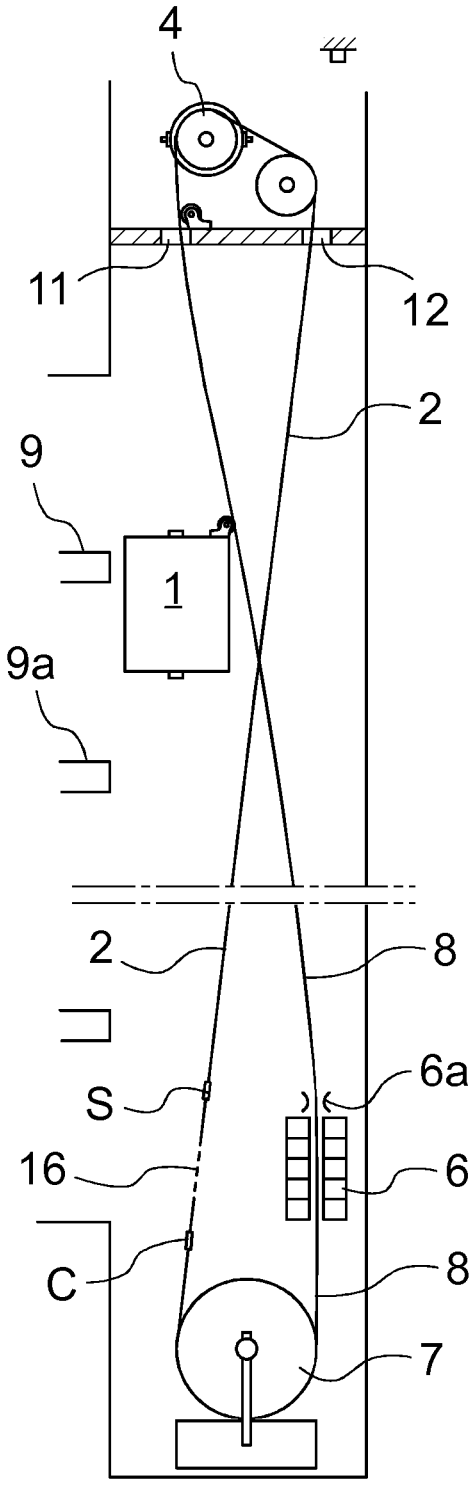
FIG. 5 presents a simplified and diagrammatic side view of an elevator according to FIG. 1, wherein the loop formed by the hoisting ropes and the compensating ropes has been driven with the elevator's own machine such that the joint between the hoisting ropes and the compensating ropes is close to the lowermost floor and to the counterweight.

FIGS. 4 and 5 present some of the next phases of the method. Next, the second ends C of the rope loops formed from the hoisting ropes 2 and the compensating ropes 8 are detached from below the elevator car 1. After this the first ends S and the second ends C of the rope loops are connected to each other with a transmission means 16, which is e.g. also made from a part of a hoisting rope 2 left over in the replacement. The length of the transmission means is essentially as great as the height of the elevator car 1 or the height of the car sling, if a car sling is in connection with the car. The joints between the transmission means 16 and the ends S and C of the ropes is made with sleeves that are as thin as possible, which sleeves fit to pass below the compensating pulley 7 and also in the grooves of the traction sheave 4 and of the diverting pulley 5.

When the ends S and C of the ropes are connected to each other with a transmission means 16, the ropes and the transmission means 16 form a closed loop, the direction of travel of which over the traction sheave 4 and the diverting pulley 5 is the opposite to what it was before the start of the replacement. In addition the ropes cross over each other once in the loop. After this the hoisting ropes 2 are detached from the support means 14 and from the fixing means 6*a* that is in connection with the counterweight, after which the loop consisting of the ropes 2 and 8 as well as of the transmission means 16 is free to be driven into a different position. In the next phase the rope loop consisting of the ropes 2 and 8 and of the transmission means 16 is driven by means of the elevator's own hoisting machine 3 and pulled by the traction sheave 4 to such a position where the transmission means 16 is close to the bottom end of the elevator hoistway and to the counterweight 6 that is there. The situation according to FIG. 5 presents this situation.

Figure 6:
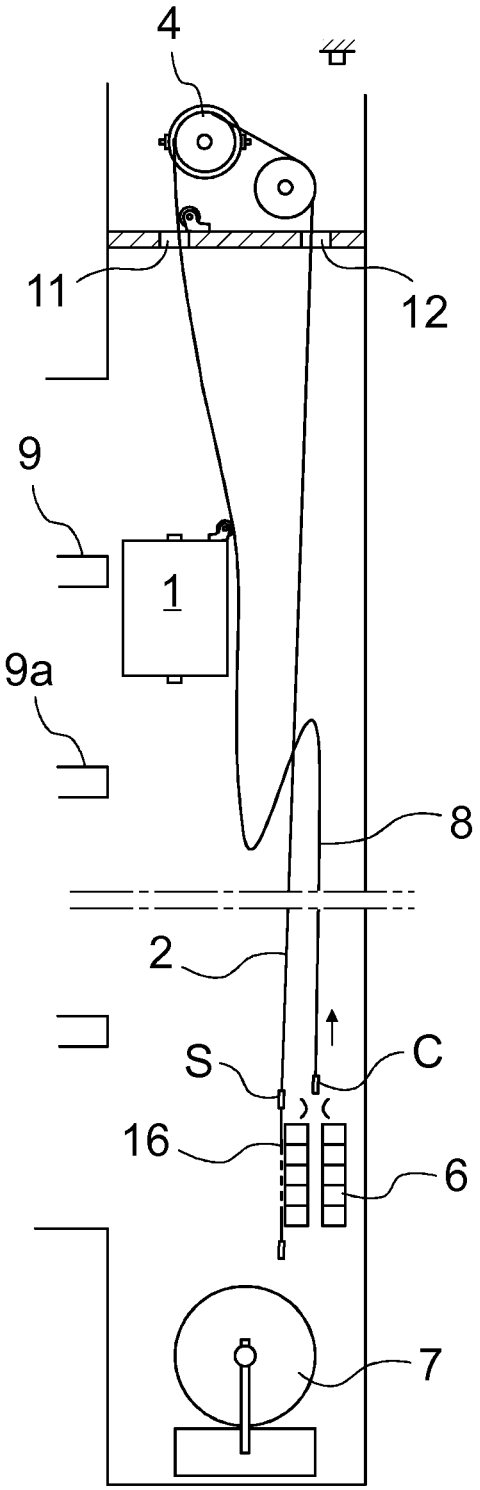
FIG. 6 presents a simplified and diagrammatic side view of an elevator according to FIG. 1, wherein the loop formed by the hoisting ropes and the compensating ropes has been opened and the former top ends of the compensating ropes have been pulled upwards through the counterweight.
Figure 7:
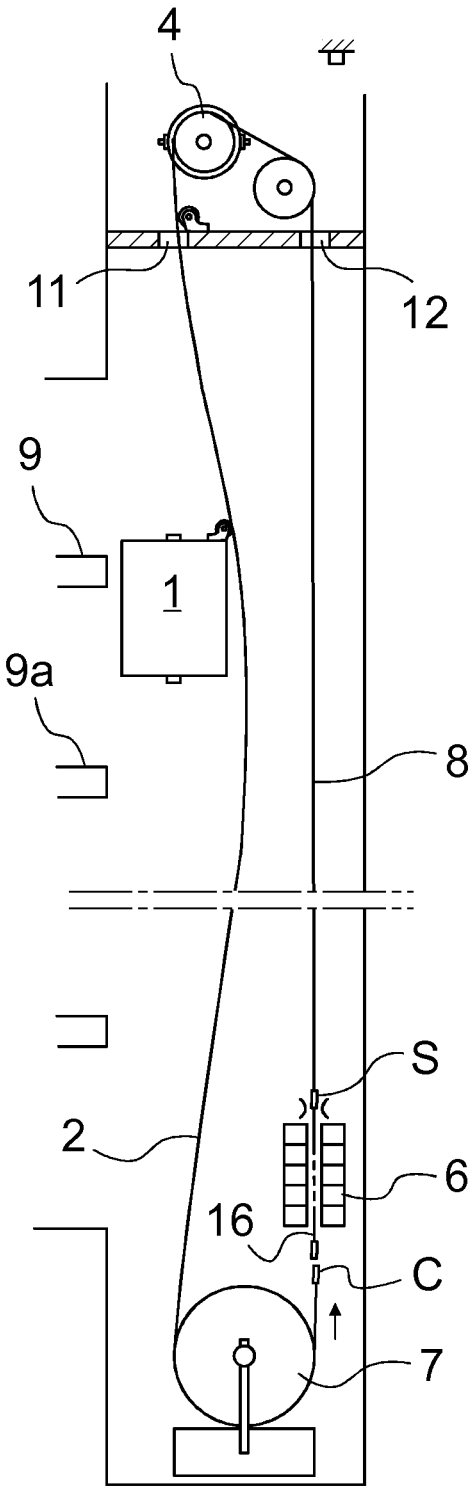
FIG. 7 presents a simplified and diagrammatic side view of an elevator according to FIG. 1, wherein the direction of travel of the ropes over the compensating pulley has been changed and the ropes are being re-connected.

FIGS. 6 and 7 further present some of the next phases of the method. In the situation according to FIG. 5 the rope loop is in balance, in which case e.g. the original second ends C of the ropes of the rope loop are detached from the transmission means 16, pulled under the compensating pulley 7 and lifted through the counterweight 6 to change the direction of travel of the ropes under the compensating pulley 7. When the second ends C have been lifted through the counterweight they are lowered to hang freely next to the counterweight and after this the transmission means 16 is threaded from above downwards through the fixing means 6*a* and counterweight 6 such that the bottom end of the transmission means 16 extends to below the counterweight 6. Next the second end C of the ropes are threaded via the other route under the compensating pulley 7 so that the direction of the ropes below the compensating pulley 7 changes to be the opposite with respect to the original direction of the ropes. After that the second ends of the ropes are again fixed to the transmission means 16 below the counterweight 6, as is presented in FIG. 7. Thus a new loop is formed, in which the ropes no longer cross over each other and in which the ropes pass around the traction sheave 4, the diverting pulley 5 and the compensating pulley 7 in the opposite direction than in the original rope loop.

Figure 8:
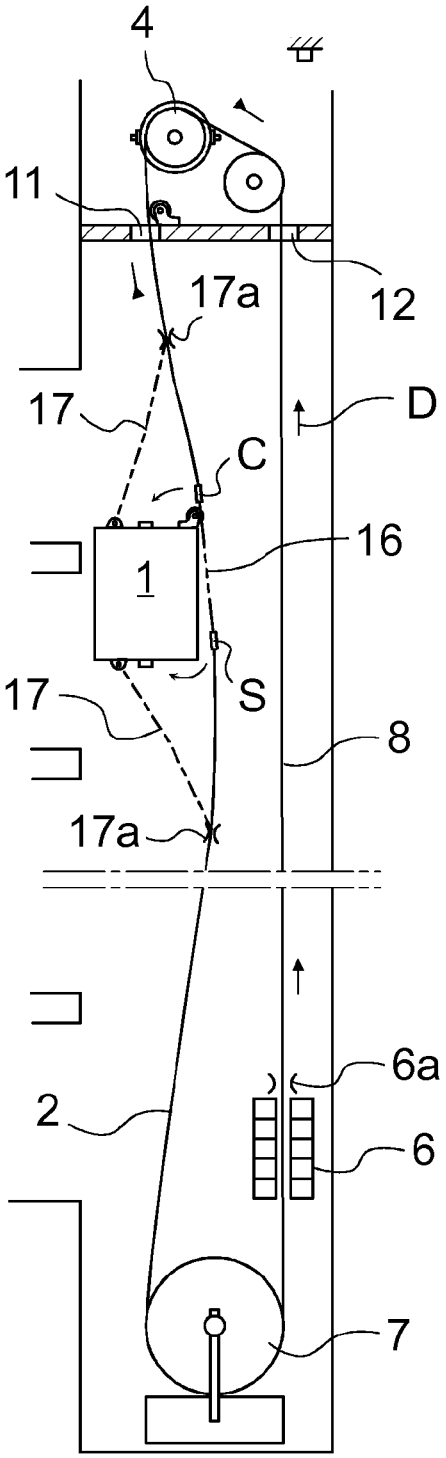
FIG. 8 presents a simplified and diagrammatic side view of an elevator according to FIG. 1, wherein the ends of the hoisting ropes and of the compensating ropes have been lifted with the elevator's own hoisting machine to near the elevator car.
Figure 9:
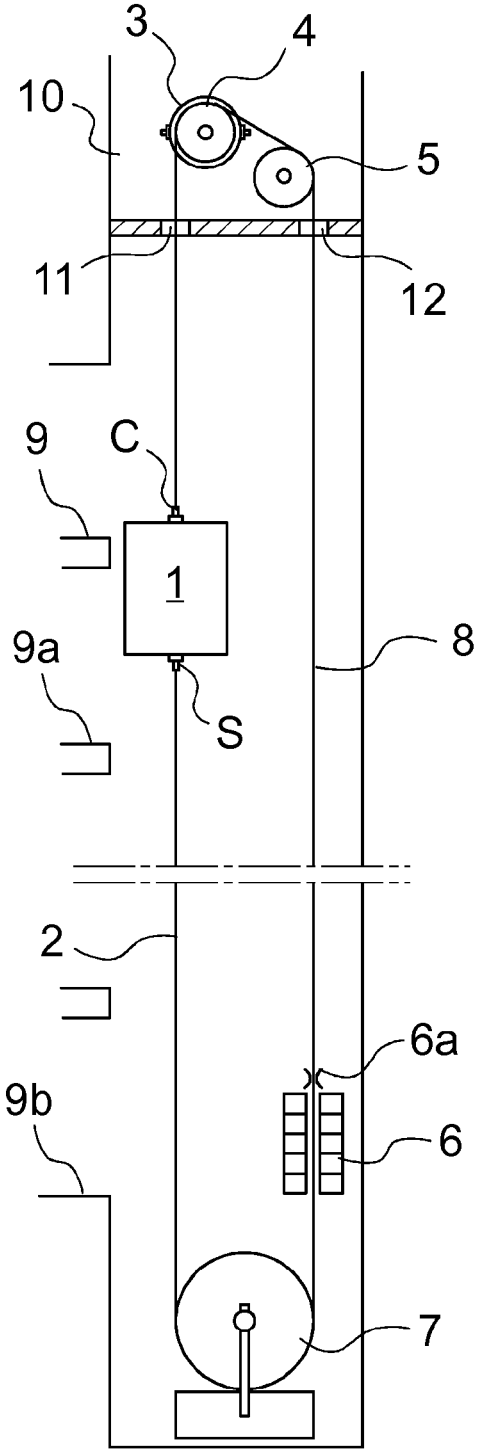
FIG. 9 presents a simplified and diagrammatic side view of an elevator according to FIG. 1, wherein the hoisting ropes and the compensating ropes have been exchanged with each other and the elevator is ready for use.

FIGS. 8 and 9 present some of the final phases of the method. When the ends of the ropes are connected to each other again by means of the transmission means 16, the rope loop is driven in the direction of the arrows D again by means of the elevator machine 3 and pulled by the traction sheave 4 to such a position in which the transmission means is at the point of the elevator car 1. In this case the second ends C of the ropes are near the top end of the elevator car 1 and the first ends S of the ropes are near the bottom part of the elevator car 1. The transmission means 16 is thus now upside-down with respect to its original position. The rope link can be driven in the opposite direction also by means of the elevator machine. In this case the transmission means 16 does not need to pass around the diverting pulley 5 nor over the traction sheave 4, but instead it passes below the compensating pulley 7.

In this phase the elevator ropes are temporarily fixed e.g. to the elevator car 1 with support means 17, the first ends of which means are fixed to the elevator car 1 and a fixing means 17*a* at the second end that do not break the rope are fixed to the elevator ropes such that one support means 17 is below the elevator car and supports the elevator ropes below it and the second support means 17 is above the elevator car 1 and prevents the elevator ropes above it from escaping upwards.

When the elevator ropes are fixed to the support means, the transmission means 16 is detached and the original second ends C of the elevator ropes are fixed to the place of the original first ends S on top of the elevator car 1. Correspondingly, the original first ends S are fixed to the place of the original second ends C below the elevator car 1. In connection with the fixing of the ends of the ropes, the ropes are tightened to their correct tension and finally the new hoisting ropes 2 are locked to the counterweight 6 with the fixing means 6*a* that is in connection with the counterweight. In addition, all the auxiliary means, such as the guide pulleys 15 and the other auxiliary devices used, are removed and the elevator car 1 and also the counterweight 6 are released from their lockings.

FIG. 9 presents the situation after the replacement. In this case the original ten, i.e. n, units of compensating ropes are now the new hoisting ropes 2 and nine, i.e., n−1, units of the original eleven hoisting ropes are now the new compensating ropes 8. Temporary support means and transmission means were made from one of the original hoisting ropes and only one original hoisting rope remained without a use.

It is obvious to the person skilled in the art that the invention is not limited solely to the example described above, but that it may be varied within the scope of the claims presented below. Thus, for example, the sequence of the phases of the method presented can be other than what is presented above, or there can be more or less phases, or the method of doing some of the phases can differ to what is presented above.

It is obvious to a person skilled in the art that the change of direction of the elevator ropes under the compensating pulley can also occur such that the second end of the transmission means is driven under the compensating pulley before the change of direction. The change of direction now occurs when the transmission means is under the compensating pulley 7. This can, in some situations, enable e.g. better replacement spaces.

It is also obvious to the person skilled in the art that the hoisting ropes of the elevator do not necessarily need to be at the start any more than the number that is calculated to be needed, but instead there can be the same number n of hoisting ropes as there should normally be. In this case the compensating ropes can be one strength grade better than the hoisting ropes, in which case in connection with the first replacement the number of hoisting ropes decreases by one compared to the calculated amount, but correspondingly the strength grade is higher so that the safety remains essentially the same.

It is also obvious to the person skilled in the art that the hoisting ropes and the compensating ropes can also be different ropes to each other, although they are in fact similar to each other and both are the same manufacturing batch as each other. In this case the ropes must be connected to each other also in the proximity of the counterweight so that a uniform rope loop is achieved, which is handled and driven in the manner described above.

The invention claimed is:

1. A method for replacing elevator ropes in an elevator having at least a hoisting machine, a traction sheave, a counterweight, and an elevator car supported by the elevator ropes, the method comprising:

converting, in connection with rope replacement, one of the elevator ropes, which acts as a compensating rope and a hoisting rope of the elevator via:

detaching a first end of the rope, which acts as the hoisting rope, from at least one of the elevator car and the counterweight; and changing a direction of the detached first end of the rope over the traction sheave and over a diverting pulley from a first direction to an opposite second direction to convert the rope to act as the compensating rope; and converting at least a portion of the rope into the compensating rope of the elevator via:

detaching a second end of the rope from the elevator car; and changing the direction of the detached second end of the rope over the compensating pulley from a third direction to an opposite fourth direction.

2. The method according to claim 1, wherein a first number of compensating ropes are converted into hoisting ropes, and a second number of hoisting ropes are converted into compensating ropes, the first number being greater than the second number.

3. The method according to claim 1, wherein after changing the direction of the rope, the method further includes, connecting the first end of the rope and the second end of the rope to form a closed rope loop, the closed rope loop being driven by the hoisting machine and the traction sheave to a position at which the first end of the rope that is detached from the elevator car is at a bottom edge of the elevator car and the second end of the rope that is detached from the elevator car is at a top edge of the elevator car.

4. The method according to claim 3, further comprising:

opening the closed rope loop;

fixing the first end of the rope that is detached from the elevator car to fixing points of the second end of the rope below the elevator car; and fixing the second end of the rope that is detached from the elevator car to fixing points of the first end of the rope on top of the elevator car.

5. The method according to claim 1, further comprising:

locking the elevator car to guide rails at a first position;

locking the counterweight at a second position;

supporting the rope between a diverting pulley and the counterweight;

detaching the first end of the rope from a top of the elevator car;

changing a direction of travel of the rope over the traction, sheave and the diverting pulley from a first direction to an opposite second direction;

detaching the second end of the rope from the bottom of the elevator car;

connecting the first end of the rope to the second end of the rope to form a closed rope loop;

unlocking the counterweight from the rope;

detaching the support to the rope between the diverting pulley and the counterweight;

driving the rope loop to a position in which the connected the first end of the rope and the second end of the rope are at the bottom part of the elevator hoistway;

disconnecting the connected first end and second end of the rope;

changing the direction of travel of the second end of the rope below the compensating pulley from a third direction to an opposite fourth direction;

re-fixing the first end and second end of the rope to form a rope loop in which the direction of travel of the rope around the traction sheave, the diverting pulley and the compensating pulley is opposite relative to an original direction;

attaching the first end of the rope to the top of the elevator car;

attaching the first end of the rope to the bottom of the elevator car;

locking the counterweight to the rope; and unlocking the elevator car from the first position and the counterweight from the second position.

6. The method according to claim 1, wherein a same continuous rope is used as a hoisting rope or as a compensating rope.

7. The method according to claim 1, wherein the rope acting as a hoisting rope or a compensating rope is a separate rope.

8. An elevator comprising;

a plurality of ropes suitable for use as hoisting ropes of said elevator, and in which elevator a plurality of hoisting ropes and compensating ropes are fitted to be interchangeable with each other; and a transmission unit, wherein:

one of the compensating ropes, in connection with rope replacement, is converted into a hoisting rope of the elevator via:

detaching a first end of the rope, which acts as a hoisting rope, from the elevator car and from the counterweight; and changing a direction of the detached first end of the rope over the traction sheave and over a diverting pulley from a first direction to an opposite second direction to convert the rope to act as a compensating rope; and at least a portion of the rope is converted into the compensating rope of the elevator via:

detaching a second end of the rope from the elevator car; and changing the direction of the detached second end of the rope over the compensating pulley from a third direction to an opposite fourth direction, wherein a length of the transmission unit is at least equal to or greater than a height of the elevator car.

9. The method according to claim 1, wherein the elevator further includes a diverting pulley and a compensating pulley, wherein detaching the first end of the rope from the elevator car and from the counterweight includes:

lifting the detached first end of the rope from the elevator car into a machine room via a first aperture in a floor of the machine room; and lowering the detached first end of the rope out of the machine room via a second aperture.

10. The method according to claim 1, wherein detaching the second end of the rope from the elevator car includes:

connecting the detached second end of the rope and the detected first end of the rope to each other via a transmission unit;

changing the direction of travel of the rope below the compensating pulley from a third direction to an opposite fourth direction;

disconnecting the connected first end and second end of the rope; and re-fixing the first end and second end of the rope to form a rope loop in which the direction of travel of the rope around the traction sheave, the diverting pulley and the compensating pulley is opposite relative to an original direction.

11. The elevator according to claim 8, wherein a joint between the transmission unit and the second end of the rope and the first end of the rope include a sleeve.

12. The elevator according to claim 11, wherein the sleeve fits to pass below the compensation pulley and in grooves of the traction sheave and the diverting pulley.

13. A method for replacing an existing elevator rope in an elevator, comprising:

detaching a first end of a rope from a top of the elevator car;

changing direction of travel of the detached rope from a first direction to an opposite second direction;

detaching a second end of the rope from a bottom of the elevator car;

connecting the first end of the rope and the second end of the rope to form a closed loop in which the direction of travel of the rope is opposite relative to an original direction;

detaching the first end of the rope and the second end of the compensating rope;

re-connecting the first end of the rope originally attached at the top of the elevator car to the bottom of the elevator car; and re-connecting the second end of the rope originally attached at the bottom of the elevator car to the top of the elevator car.

14. A method for replacing an existing elevator rope which acts as a hoisting rope and a compensating rope in an elevator, comprising:

detaching a first end of the rope from a top of the elevator car;

changing direction of travel of the detached rope from a first direction to an opposite second direction;

detaching a second end of the rope from a bottom of the elevator car;

connecting the first end of the rope and the second end of the rope to form a closed loop in which the direction of travel of the rope is opposite relative to an original direction;

detaching the first end of the rope and the second end of the rope;

changing direction of travel of the detached second end of the rope from a third direction to an opposite fourth direction;

re-connecting the first end of the rope originally attached at the top of the elevator car to the bottom of the elevator car; and re-connecting the second end of the rope originally attached at the bottom of the elevator car to the top of the elevator car.

15. A method for replacing an existing elevator rope in an elevator, comprising:

securing an elevator car in a first position;

securing a counterweight in a second position;

detaching a first end of a rope from a top of the elevator car;

changing direction of travel of the detached rope over a traction sheave and a diverting pulley in a machine room from a first direction to an opposite second direction;

detaching a second end of the rope from a bottom of the elevator car;

connecting the first end of the rope and the second end of the rope to form a closed loop in which the direction of travel of the rope is opposite relative to an original direction;

detaching the first end of the rope and the second end of the rope;

changing direction of travel of the detached second end of the rope below a compensating pulley from a third direction to an opposite fourth direction;

re-connecting the first end of the rope originally attached at the top of the elevator car to the bottom of the elevator car;

re-connecting the second end of the rope originally attached at the bottom of the elevator car to the top of the elevator car; and unsecuring the elevator car from the first position and the counterweight from the second position.

* * * * *